US006394365B1

(12) United States Patent
Jeanfreau

(10) Patent No.: US 6,394,365 B1
(45) Date of Patent: May 28, 2002

(54) PORTABLE DYNAMIC PRE-PRESSURIZED SPRAYER FOR USE WITH WATER OR DILUTE AQUEOUS SOLUTION

(76) Inventor: Kevin M. Jeanfreau, 27061 Hwy. 435, Abita Springs, LA (US) 70420

( * ) Notice: Subject to any disclaimer, the term of this patent is extended or adjusted under 35 U.S.C. 154(b) by 0 days.

(21) Appl. No.: 09/557,012

(22) Filed: Apr. 20, 2000

(51) Int. Cl.[7] ..... B05B 9/04

(52) U.S. Cl. ..... 239/373; 239/146; 239/304; 239/323; 239/407; 239/530; 222/386.5

(58) Field of Search ..... 239/146, 148, 239/304, 303, 307, 308, 310, 323, 373, 530, 407; 222/386.5, 608

(56) References Cited

U.S. PATENT DOCUMENTS

| | | | | |
|---|---|---|---|---|
| 1,384,296 A | | 7/1921 | Gardner | |
| 2,199,110 A | | 4/1940 | Metz | 299/85 |
| 2,513,455 A | * | 7/1950 | Cornelius | 222/386.5 |
| 2,847,249 A | | 8/1958 | Evans | 299/90 |
| 3,108,970 A | | 10/1963 | Luvisi | 252/309 |
| 3,184,113 A | | 5/1965 | Curtis | 222/386.5 |
| 3,504,858 A | * | 4/1970 | Liddiard | 239/373 X |
| 3,865,308 A | * | 2/1975 | Pringle et al. | 239/304 X |
| 4,159,081 A | | 6/1979 | Demier et al. | 239/323 |
| 4,962,888 A | | 10/1990 | Beccaria et al. | 239/152 |
| 5,213,263 A | * | 5/1993 | Corona | 239/304 |
| 5,398,852 A | | 3/1995 | Lacy | 84/383 |
| 5,671,884 A | * | 9/1997 | Restive | 239/373 X |

FOREIGN PATENT DOCUMENTS

| | | | |
|---|---|---|---|
| GB | 734723 | 8/1955 | 69/111 |

* cited by examiner

*Primary Examiner*—Steven J. Ganey
(74) *Attorney, Agent, or Firm*—Garvey, Smith, Nehrbass & Doody, LLC; Charles C. Garvey, Jr.

(57) ABSTRACT

A sprayer apparatus uses a larger canister to contain diluent (e.g. water) and a smaller canister to contain chemical concentrate (e.g. insecticide, fertilizer, soap, etc.). The larger canister has a bladder or diaphragm that separates its interior into two sections; a liquid chamber and a pressured gas chamber. A valved manifold enables diluent to be added to the apparatus via the manifold so that it mixes with the desired chemical concentrate. Mixed solution can then be dispensed via a hose, spray wand, etc. using the pressurized air to drive it out of the larger canister.

21 Claims, 4 Drawing Sheets

PORTABLE DYNAMIC PRE-PRESSURIZED SPRAYER FOR USE WITH WATER OR DILUTE AQUEOUS SOLUTION

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to pressurized liquid sprayers and more particularly to a sprayer that has a canister with a chamber interior for holding both air and a liquid, the liquid compressing the air as the canister is filled and wherein a specially configured mixing chamber receives liquid from the canister and mixes it with a desired chemical product (eg. chemical concentrate, insecticide, soap, fertilizer, etc.) before transmitting the mixed solution to a valved spray wand or spray head.

2. General Background of the Invention

Common pump-type sprayers often provide a container that holds several gallons of liquid. Most of these prior art type pump sprayers require pre-mixing of an amount of diluent such as water that is combined with a given, typically smaller volume of chemical concentrate such as a fertilizer, insecticide, soap, or the like.

These prior art type pump sprayers require a constant recharge of air pressure via a hand pump arrangement. Pump arrangements on commercially available and known sprayers include reciprocating pumps or lever action pumps. As the user dispenses mixed liquid through a spray head, the pump pressure gradually decreases and the user must again manually pump the unit. Such pump sprayers are usually designed to carry relatively small volumes, eg. 1–3 gallons.

More expensive sprayer arrangements are known that utilize an electric motor in combination with a tank. Such sprayers are typically available in 10, 15 and 25 gallon capacities. An example of such an electrically powered sprayer is sold by John Deere® wherein a user activates the electric pump when the spray head is valved to an open position, and wherein the electric motor is deactivated when the spray head valve is closed.

Some sprayer constructions that use tanks and bladders with pressurized air are disclosed in U.S. patents. Devices that have a bladder or diaphragm require an external source that is constantly communicating with a supply pressure for dispensing contents.

U.S. Pat. Nos. 2,847,249; 1,384,296; 4,962,888; and 5,398,852 all relate to sprayers that hold a fluid that is rejected by pressurized air contained within a canister. The '249 patent utilizes a garden hose that adds water to a pressurized canister wherein a bladder of rubber or like material compresses the air as the water is added under pressure.

The Lacy patent 5,398,852 features a tank cap that connects to a standard garden hose and uses household water pressure to pressurize a tank interior and its contents.

U.S. Pat. No. 4,159,081 and British Patent No. 7347723 disclose sprayers for hand held, manual operation.

U.S. Pat. No. 3,018,970 discloses a garden hose used to pressurized a chamber of a sprayer.

U.S. Pat. Nos. 2,199,110 and 3,184,113 disclose portable sprayers with bladders inside that segregate the fluid to be dispensed from pressurized air on the opposing side of the bladder that propels the spray.

Most of these prior art patents do not provide an effective method of mixing a chemical to be dispensed in precise concentration without messy pre-mixing.

Most prior art sprayers either require tiring manual operation for pumping or involve the extraordinary expense of electrical motors and related power source problems.

BRIEF SUMMARY OF THE INVENTION

The present invention provides an improved sprayer apparatus that utilizes two separate chambers or canisters. The apparatus features a pre-charged or pre-pressurized bladder tank that is a larger tank or canister. The larger canister has an interior and an outlet, with an interior having a pressurized gas chamber contained that holds gas (eg. air) under pressure during use. The larger canister also includes a liquid chamber for holding a liquid solution, namely the combination of a bulk liquid (usually water) and chemical concentrate solution.

The second canister is a smaller, chemical concentrate containing housing. This chemical housing has a chamber that holds a desired concentrate. Both canisters are mounted on a frame that can be wheeled.

The chemical concentrate housing chamber holds a selected chemical concentrate to be mixed with a bulk or diluent liquid. A chemical concentrate is added to the solution housing; the final solution is formed by the addition of water to the solution housing via the manifold which mixes the water and concentrate together as they are transferred into the liquid side of the bladder tank.

The smaller chemical concentrate housing and valving defines a valved manifold arrangement connected to the canister at the outlet with a flowline. The manifold is configured to valve the flow of fluids as selected by a user into either the liquid chamber or into the chemical solution chamber via the concentrate chamber, or to cease any such flow.

The apparatus includes a spray hose and valve arrangement that enables the user to dispense a mixed solution of water and chemical or a selected liquid and chemical, the spray valve and hose being connected to the manifold. When the system is attached to a garden hose and filled under typical water pressure from the hose, the pre-pressurized air increases in pressure until reaching equilibrium with the pressure from the hose. The hose is then disconnected and the contents are discharged by the pressure developed in the filling stage. The air pressure decreases as the liquid is discharged until all the liquid is emptied, however, the pre-charged level of air pressure is maintained. The pre-charged or pre-pressurized setting is fully adjustable. Since it is set at the lowest working pressure, all the contents will be discharged without any need for a pump of any kind.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
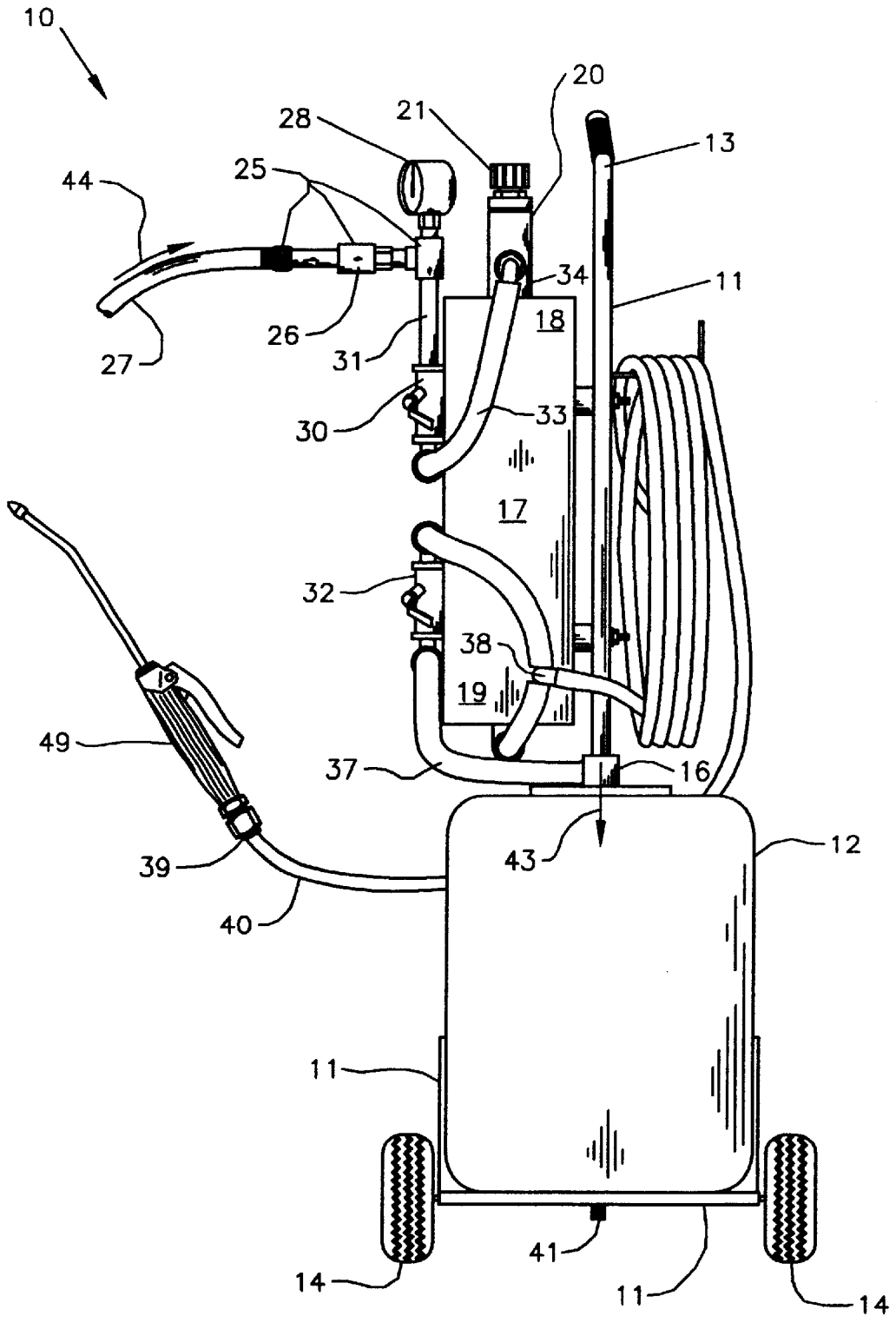
FIG. 1 is an elevational view of the preferred embodiment of the apparatus of the present invention.
Figure 2:
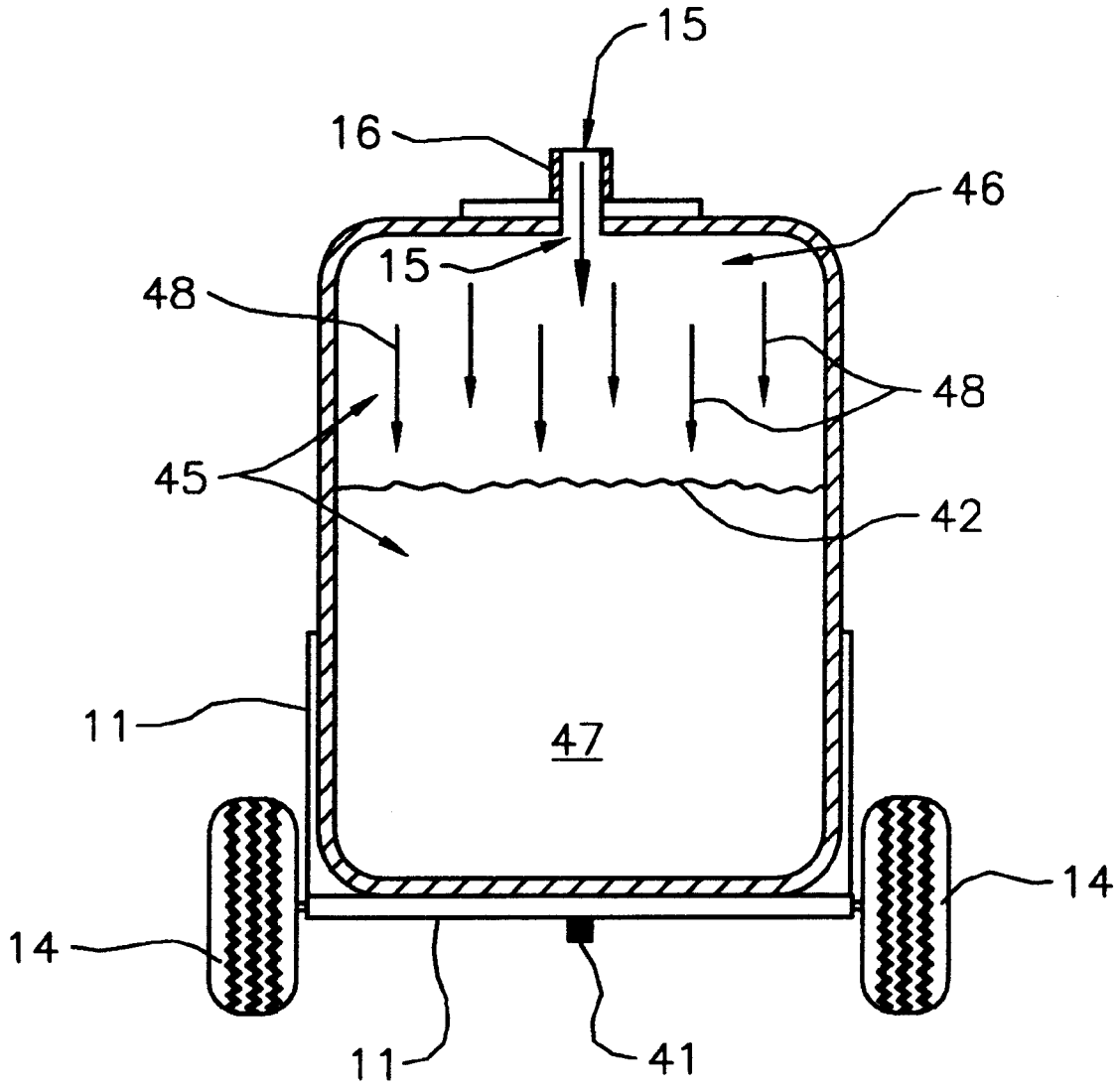
FIG. 2 is a partial elevational view of the preferred embodiment of the apparatus of the present invention.
Figure 3:
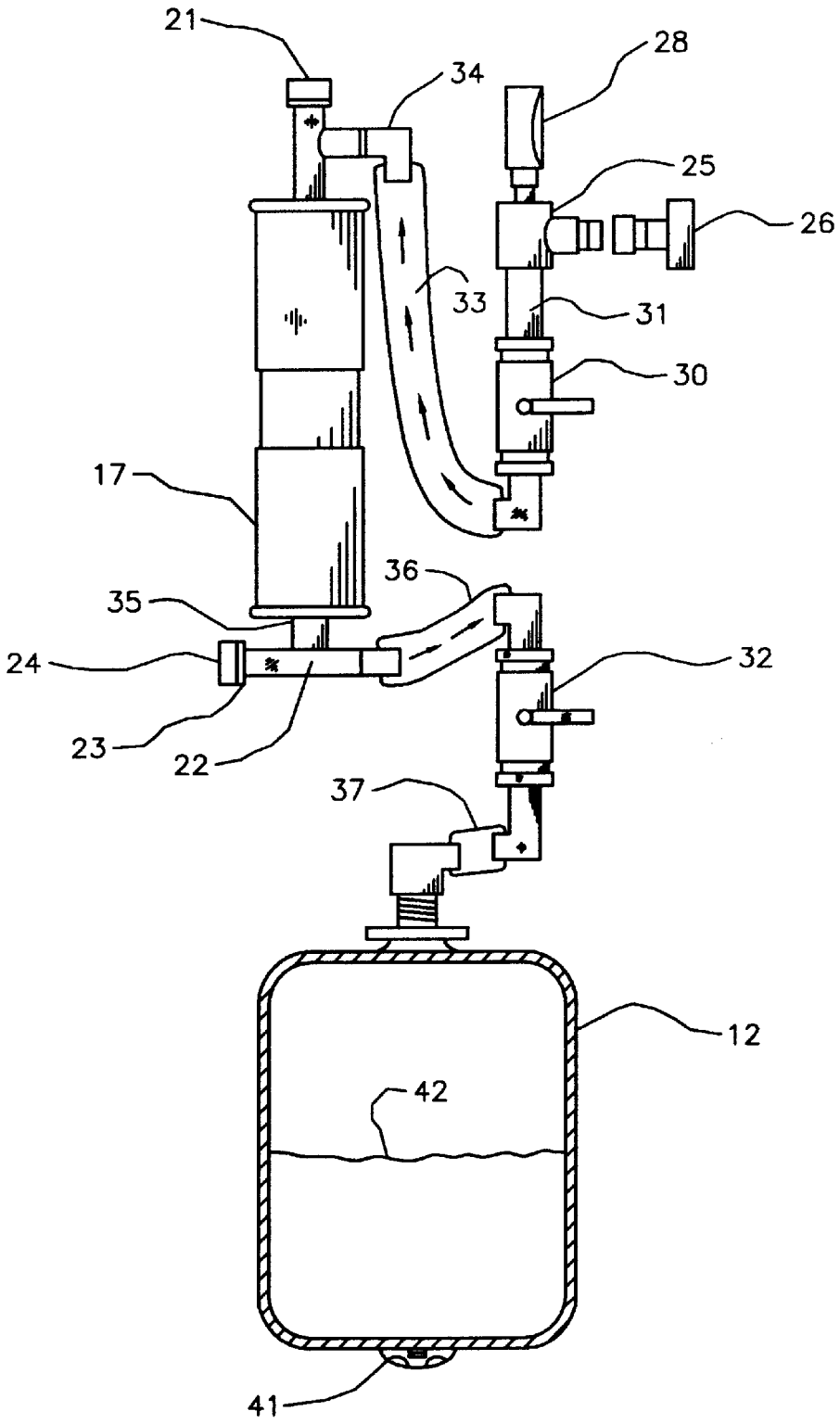
FIG. 3 is a partial exploded view of the preferred embodiment of the apparatus of the present invention showing some of the components and removed from the frame for clarity.

FIGS. 1–3 show generally the preferred embodiment of the apparatus of the present invention designated generally by the numeral 10 in FIG. 1. Spray apparatus 10 includes a frame or housing 11 that carries a first larger vessel in the form of housing or canister 12. Frame 11 has a handle 13 that enables a user to wheel the frame 11 about. The frame 11 preferably provides a lower end portion with a pair of spaced apart wheels 14. Canister 12 is mounted on frame 11. A second canister or housing in the form of chemical concentrate housing 17 is also mounted to frame 11.

Canister 12 has an upper end portion with opening 15. Opening 15 carries an outlet fitting 16 that receives flow via hose 37, valve 32 and hose 36 from chemical vessel 17. Chemical vessel 17 has an upper end portion 18 and a lower end portion 19. Upper end portion 18 provides a fill opening 20 with a closure cap 21. The lower end 19 portion of chemical vessel 17 provides tee fitting 22. The tee fitting 22 has a drain fitting 23 with closure cap 24. This configuration enables a user to drain vessel 17 completely, such as in situations wherein the user wants to replenish vessel 17 or to completely evacuate the contents of vessel 17 and add a different chemical to it.

After chemical is added to chamber 17 via fill opening 20, closure cap 21 is replaced and water is added to the vessel 17 for mixing therewith. Prior to mixing, upper valve 30 and lower valve 32 are closed. A source of liquid, such as water supplied with city or well water via water hose 27 can be added to vessel 17 at water inlet manifold 25.

Inlet manifold 25 includes a connection for hose 27, quick release fitting 26 that can be a commercially available, valving type quick release fitting 26 and a tee at gauge 28. Such a fitting 26 shuts off the supply of water from hose 27 when the quick release fitting 26 is disconnected. Pressure gauge 28 is supplied to inlet manifold 25 for monitoring the pressure of any fluid supplied under pressure via water supply hose 27. The gauge 18 can be provided with indicia to indicate the line pressure and the number of gallons the system will hold at a particular line pressure. In this fashion, the correct ratio of chemical can be added to the chemical housing. The pressure indicated by pressure gauge 28 is also used to monitor the pressure within canister 12 during spraying and when valves 30 and 32 are opened. In this fashion, a user knows how much of the liquid contents of canister 12 have been evacuated by watching the pressure drop at pressure gauge 28.

Flow line 31 extends from inlet manifold 25 to upper valve 30. This enables water to flow from inlet manifold 25 into flow line 31 and into hose 33. Hose 33 communicates with inlet fitting 34 to supply water to the interior of chemical vessel 17 at its upper end 18. Water that enters at inlet fitting 34 travels downwardly, substantially the full length of chemical vessel 17. At the lower end 19 of chemical vessel 17, water that has been mixed with the chemical contained within vessel 17 is discharged at outlet fitting 35 into tee 22 and into hose 36. Hose 36 communicates with a fitting at the top of valve 32. Fluid exiting valve 32 enters hose 37. Hose 37 then enters canister 12 at inlet fitting 15 as indicated by arrow 43 in FIG. 1. Hose 37 also carries tee fitting 38.

During use, the user shuts the valve 30 and connects hose 27 to inlet manifold 25 at quick release fitting 26. Valve 32 is opened. The hose 27 is then supplied with water flowing in the direction of arrow 44 in FIG. 1 under pressure from a faucet and a city water or well water supply, for example. Once the hose 27 is pressurized, pressure gauge 28 indicates the pressure of the city water supply, well water supply or the like. With the valve 30 closed, the user fills chemical vessel 17 through fill opening 20 and closes the closure cap 21. Vessel 17 now contains a desired amount of chemical concentrate, such as a pesticide, fertilizer, soap or the like. In order to fill the canister 12 with a combination of the chemical concentrate in vessel 17 and water supplied via hose 27, the user opens valve 30.

Figure 4:
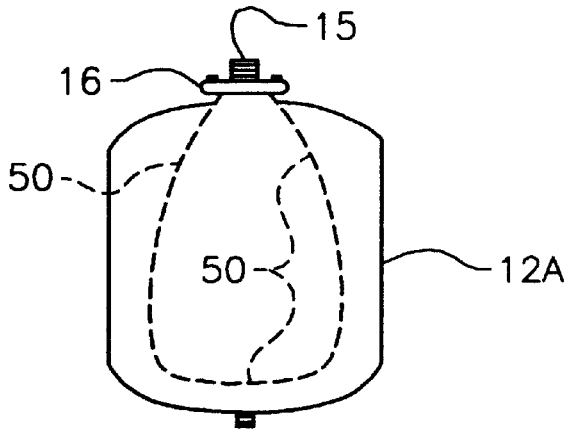
FIGS. 4 and 5 are alternate constructions for the tank portion of the preferred embodiment of the apparatus of the present invention.
Figure 5:
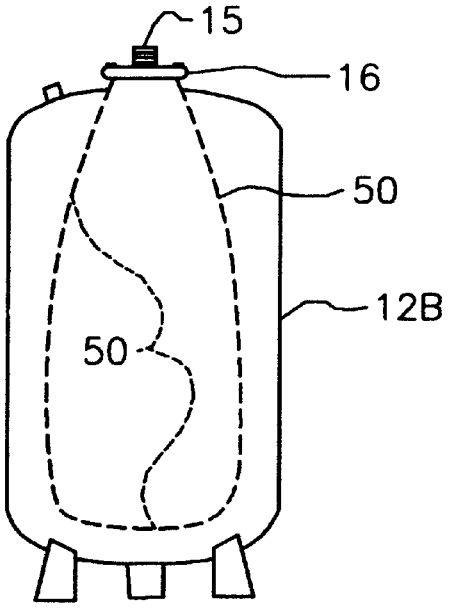

Fluid flows from hose 27 to manifold 25 to flow line 31 to valve 30 to hose 33 to inlet fitting 34 and into vessel 17. A mixture of chemical concentrate and water then exits the lower end of vessel 17 at fitting 35 and then flows into hose 36, valve 32, hose 37, inlet fitting 15 and into chemical concentrate housing 17. Canister 12 has a hollow interior 45 that is divided with a diaphragm or bladder 42 into an interior of bladder liquid containing portion 46 and bladder pre-pressurized air containing portion 47. Alternatively, the canister 12A or 12B (see FIGS. 4–5) can be provided with a bladder 50 that receives liquid via fitting 16 on inlet 15. As liquid enters canister 12 via inlet fitting 15 (see arrows 48 in FIG. 2), air outside bladder 42 is further compressed. This compressed air provides pressure to dispense fluid from canister 12 to hose 40 and its spray wand. Air valve 41 can be used to add a volume of air to canister interior 45 at air containing portion 47.

Spray hose 40 connects to hose 36 at tee fitting 38. In order to dispense the contents of canister 12 through spray hose 40 and to a valved sprayer head or wand connected to hose 40 at 39, valves 30 and 32 are opened. This allows solution to flow via outlet fitting 15 through hose 37 through valve 32 into hose 36, and into tee fitting 38 and then to hose 40 for dispensing. Valve 30 remains open so that gauge 28 can monitor pressure/volume as contents are dispensed.

In order to fill the apparatus 10 and to recharge the contents of the vessels, this process is repeated by closing both of the valves 30, 32 and again filling the chambers 17 and 12. Air valve (e.g. Schraeder type) 41 can be used to increase the pressure of air in canister 12 outside bladder 42 if a higher operating pressure is desired when water supply hose 27 has a corresponding higher pressure. For example, a user might have been using well water at a pressure of 30 psi. If the user then finds a city water source with a pressure of 60 psi, air can be added to interior 45 at 47 to increase pressure since the 60 psi water pressure can compress a greater volume of air to a given pressure valve.

The only time valve 30 is closed, is to isolate gauge 28 to read line pressure of hose 27, thereby indicating what volume the system will hold so the correct ratio of concentrate can be added to vessel 17 prior to filling.

The only time valve 32 is closed is when tank 12 needs to be isolated with a remaining volume of solution so that the system can be refilled before tank 12 is completely emptied or to isolate tank 12 with contents under pressure, so that the rest of the system can be depressurized during a long period of non-use.

Lines 13 through 22: The primary purpose of air valve 41 is to give the user flexibility in setting the pre-pressurized level of air in tank 12. Some applications will require a higher or lower minimum discharge pressure which is the pre-pressurized setting. This setting can be adjusted any time tank 12 is empty of all liquid contents.

The volume capacity is in direct relation to the inlet pressure at hose 27 and the pre-pressurized setting: Higher Inlet pressure at hose 27 and lower pre-pressure setting= greater volume capacity.

Operating Instructions

1. Attach the female end of the quick connector (26 FIGS. 1–3) to the male end of a garden hose (27 FIG. 1). Turn hose on—fully open. [Both ends of the quick connector automatically close when the two are disconnected.]
2. Close the inlet/fill valve (30 FIG. 1) on the sprayer, tank valve (32) stays open at this step if system is empty.
3. Attach the Quick Connector on the hose to the male end of the sprayer, the gauge (28 FIG. 1) will immediately display line pressure and how much volume the system will hold at that pressure.
4. If a chemical solution is going to be used, add the correct ratio to the solution housing (17 FIG. 1). If plain water is used go to step 5. [Make sure the solution fill cap (21) is closed and the solution drain cap (24 FIG. 3) is closed; both hand tight before going to step 5]
5. Open the inlet/fill valve (30). The system is full when the gauge (28) reads the same level as in step 3.
6. Disconnect the quick connector from the sprayer. [Both ends of the quick connector automatically close when the two are disconnected.] System is now ready for use. [The system will discharge all the contents under normal working pressure until empty.]

To Refill Before Empty

A. Make a note as to the remaining volume.

B. Close tank valve (32), then open trigger on hand held sprayer (49 FIG. 1), this releases pressure from the solution housing (17).

C. Open solution fill cap (21), then solution drain cap (24 FIG. 3) to drain solution tank.

D. Repeat steps 1–6

1. Subtract remaining volume from step A from the volume read in step 3, so that the correct ratio is added.
2. Open tank valve (32) before opening inlet/fill valve (30) in step 5.

Notes

Both inlet/fill (30) and tank (32) valves remain open in operation

If a system under pressure is left unattended for an extended period of time, close tank valve (32) and open trigger on sprayer to release pressure in solution housing.

To store a system for a period of non-use; Drain any contents completely. Fill system with fresh water and drain, repeat.

| PART NO. | DESCRIPTION |
|---|---|
| 10 | sprayer apparatus |
| 11 | frame |

-continued

| PART NO. | DESCRIPTION |
|---|---|
| 12 | canister |
| 13 | handle |
| 14 | wheel |
| 15 | canister opening |
| 16 | fitting |
| 17 | chemical vessel |
| 18 | upper end |
| 19 | lower end |
| 20 | fill opening |
| 21 | closure cap |
| 22 | Tee fitting |
| 23 | drain fitting |
| 24 | closure cap |
| 25 | water inlet manifold |
| 26 | quick release fitting |
| 27 | water supply hose |
| 28 | pressure gauge |
| 30 | upper valve |
| 31 | flow line |
| 32 | lower valve |
| 33 | hose |
| 34 | inlet fitting |
| 35 | outlet fitting |
| 36 | hose |
| 37 | hose |
| 38 | tee fitting |
| 39 | spray wand connection |
| 40 | sprayer hose |
| 41 | air valve |
| 42 | diaphragm |
| 43 | arrow |
| 44 | arrow |
| 45 | canister interior |
| 46 | water containing portion |
| 47 | air containing portion |
| 48 | arrow |
| 49 | spray wand |
| 50 | bladder |

The foregoing embodiments are presented by way of example only; the scope of the present invention is to be limited only by the following claims.

What is claimed is:

1. A sprayer apparatus, comprising:

a) a canister having an interior and an outlet;

b) a pressurized gas chamber contained within the canister interior for holding pressurized gas;

c) a canister liquid chamber inside the canister interior for holding liquid;

d) a chemical solution canister having a chemical concentrate solution chamber for holding a selected chemical concentrate solution;

e) a valved manifold that is connected to the canister at the outlet, said manifold being configured to valve the flow of a diluent liquid into the chemical concentrate solution chamber, the manifold providing an opening for adding chemical concentrate to the manifold and valving that enables a mixture of diluent liquid and chemical concentrate to flow from the chemical concentrate chamber to the canister liquid chamber;

f) a spray valve;

g) a hose that connects the spray valve to the manifold; and h) the manifold including valving that enables a flow of liquid from the liquid chamber to the hose via the manifold.

2. The sprayer apparatus of claim 1 wherein the canister liquid chamber carries a solution of water and chemical concentrate during use.

3. The sprayer apparatus of claim 1 wherein the canister is mounted on a wheeled frame.

4. A sprayer apparatus, comprising:

a) a canister having an interior and an outlet;

b) a pressurized gas chamber contained within the canister interior for holding pressurized gas;

c) a canister liquid chamber inside the canister interior for holding liquid;

d) the canister further comprising a bladder that separates the gas chamber and the liquid chamber e) a chemical solution canister having a chemical concentrate solution chamber for holding a selected chemical concentrate solution;

f) a valved manifold that is connected to the canister at the outlet, said manifold being configured to valve the flow of a diluent liquid into the chemical concentrate solution chamber, the manifold providing an opening for adding chemical concentrate to the manifold, and valving that enables a mixture of diluent liquid and chemical concentrate to flow from the chemical concentrate chamber to the canister liquid chamber;

g) a spray valve; and h) a hose that connects the spray valve to the manifold.

5. The sprayer apparatus of claim 4 wherein the bladder is elastomeric.

6. The sprayer apparatus of claim 5 wherein the bladder is rubber.

7. The sprayer apparatus of claim 4 wherein the canister has interior and exterior chambers separated by the bladder.

8. The sprayer apparatus of claim 7 wherein the interior chamber is the liquid chamber.

9. The sprayer apparatus of claim 7 wherein the exterior chamber is the gas chamber.

10. A sprayer apparatus, comprising:

a) a first canister having an interior and an outlet;

b) a pressurized gas chamber contained within the first canister interior for holding pressurized gas:

c) a liquid chamber inside the first canister;

d) a second canister having a chemical concentrate solution chamber for holding a selected chemical concentrate solution;

e) a valved manifold that is connected to the first canister at the outlet and that is in communication with the liquid chamber, said manifold being configured to fill either the liquid chamber or the chemical concentrate solution chamber by valving the flow of liquids as selected by a user into either the chemical solution concentrate chamber or into the liquid chamber via the chemical concentrate solution chamber; or to cease any such flow, said valved manifold including said second canister;

f) a spray hose that connects to the manifold for transmitting fluid to be sprayed from the liquid chamber; and g) wherein the valved manifold includes a plurality of valves that can be opened and closed to simultaneously mix liquid diluent from a pressurized source with the selected chemical concentrate solution chamber, enable liquid chamber to be filled with the liquid diluent and chemical concentrate solution mixture to compress gas in the gas chamber, and disallow discharge of liquid diluent and chemical concentrate solution mixture via the spray hose.

11. The sprayer apparatus of claim 10 wherein the diluent comprises water.

12. The sprayer apparatus of claim 11 wherein the first canister has interior and exterior chambers separated by the bladder.

13. The sprayer apparatus of claim 12 wherein the interior chamber is the liquid chamber.

14. The sprayer apparatus of claim 12 wherein the exterior chamber is the gas chamber.

15. The sprayer apparatus of claim 11 wherein each of the canisters is mounted on a wheeled frame.

16. The sprayer apparatus of claim 11 wherein the plurality of valves include an upper valve and a lower valve and flowlines that connect said valves to said first and second canisters.

17. The sprayer apparatus of claim 16 wherein said plurality of valves and flowlines are configured to transmit liquid in sequence to said upper valve, said second canister, said lower valve and said first canister.

18. The sprayer apparatus of claim 16 wherein one of said flowlines communicates with the upper end of said second canister.

19. The sprayer apparatus of claim 10 further comprising a bladder that separates the gas chamber and the liquid chamber.

20. The sprayer apparatus of claim 19 wherein the bladder is elastomeric.

21. The sprayer apparatus of claim 20 wherein the bladder is rubber.

* * * * *